US008005244B2

(12) United States Patent
Chanda et al.

(10) Patent No.: US 8,005,244 B2
(45) Date of Patent: Aug. 23, 2011

(54) APPARATUS FOR IMPLEMENTING 3-DIMENSIONAL VIRTUAL SOUND AND METHOD THEREOF

(75) Inventors: Pinaki Shankar Chanda, Bangalore (IN); Sung Jin Park, Gyeonggi-do (KR); Gi Woo Park, Seoul (KR)

(73) Assignee: LG Electronics, Inc., Seoul (KR)

( * ) Notice: Subject to any disclaimer, the term of this patent is extended or adjusted under 35 U.S.C. 154(b) by 1481 days.

(21) Appl. No.: 11/347,695

(22) Filed: Feb. 3, 2006

(65) Prior Publication Data

US 2006/0177078 A1 Aug. 10, 2006

(30) Foreign Application Priority Data

Feb. 4, 2005 (KR) ..... 10-2005-0010373

(51) Int. Cl.
*H04R 5/02* (2006.01)

(52) U.S. Cl. ..... 381/310; 381/309; 381/17

(58) Field of Classification Search ..... 381/17, 381/307, 310, 1, 18, 309, 97; 708/300, 303
See application file for complete search history.

(56) References Cited

U.S. PATENT DOCUMENTS

| | | | | |
|---|---|---|---|---|
| 5,928,311 | A | 7/1999 | Leavy et al. | |
| 5,943,427 | A * | 8/1999 | Massie et al. | 381/17 |
| 7,231,054 | B1 * | 6/2007 | Jot et al. | 381/310 |
| 2002/0196947 | A1 * | 12/2002 | Lapicque | 381/17 |
| 2006/0198542 | A1 * | 9/2006 | Benjelloun Touimi et al. | 381/307 |

FOREIGN PATENT DOCUMENTS

| | | |
|---|---|---|
| JP | 06-165299 | 6/1994 |
| JP | 1997-191500 | 7/1997 |
| JP | 09-284899 | 10/1997 |
| JP | 1998-257598 | 9/1998 |
| JP | 2000-023299 | 1/2000 |
| JP | 2001-517050 | 10/2001 |
| JP | 2002-135899 | 5/2002 |

(Continued)

OTHER PUBLICATIONS

Kistler and Wightman, A model of head related trasfer function based on principal component analysis and minimum phase reconstruction, Mar. 1992, Acoustic Society of America, pp. 1637-1647.*

(Continued)

*Primary Examiner* — Vivian Chin
*Assistant Examiner* — Friedrich W Fahnert
(74) *Attorney, Agent, or Firm* — Lee, Hong, Degerman, Kang & Waimey

(57) ABSTRACT

An apparatus for implementing a 3-dimensional virtual sound and method thereof are disclosed, in which computational and storage complexity are reduced, in which system stability is secured, and by which the 3-dimensional virtual sound can be implemented in such a mobile platform failing to be equipped with expensive instruments for the implementation of the 3-dimensional sound as a mobile communication terminal and the like. The present invention includes a first step of giving an inter-aural time delay (ITD) to at least one input sound signal, a second step of multiplying output signals of the first step by principal component weight, and a third step of filtering result values of the second step by a plurality of low-order approximated IIR filter models of basis vectors extracted from a head related transfer function (HRTF). The basis vectors, extracted from the head related transfer function database are approximated using balanced model approximation technique.

24 Claims, 4 Drawing Sheets

FOREIGN PATENT DOCUMENTS

| | | |
|---|---|---|
| JP | 2003-304600 | 10/2003 |
| JP | 2004-201194 | 7/2004 |
| WO | 2004080124 | 9/2004 |

OTHER PUBLICATIONS

Beliczynski, Kale and Cain, Approximation of FIR by IIR digital filters: an algorithm based on balanced model reduction, Mar. 1992, IEEE Transactions on Signal Processing, vol. 40. No. 3, pp. 532-542.*

Evans, et. al., "Analyzing Head-Related Transfer Function Measurements Using Spherical Harmonics", Journal of the Acoustical Society of America, vol. 104, No. 4, Oct. 1998, XP002529303, pp. 2400-2411.

Beliczynski, et. al., "Approximation of FIR by IIR Digital Filters: An Algorithm Based on Balanced Model Reduction", IEEE Transactions on Signals Processing, vol. 30, No. 3, Mar. 1992, XP002529304, pp. 532-542.

Chanda, et. al. "Low Order Modeling for Multiple Moving Sound Synthesis Using Head-Related Transfer Functions' Principal Basis Vectors", Neural Networks, 2005. Proceedings. 2005 IEEE International Joint Conference on Montreal, Jul. 31, 2005, pp. 2036-2040, vol. 4, XP031213291.

Wu, Z., et al.; "A Time Domain Binaural Model Based on Spatial Feature Extraction for the Head-Related Transfer Function"; The Journal of the Acoustical Society of America; vol. 102; No. 4; pp. 2211-2218; Jun. 11, 1997.

* cited by examiner

APPARATUS FOR IMPLEMENTING 3-DIMENSIONAL VIRTUAL SOUND AND METHOD THEREOF

CROSS REFERENCE TO RELATED APPLICATION

This application claims the benefit of the Korean Patent Application No. 10-2005-0010373, filed on Feb. 4, 2005, which is hereby incorporated by reference as if fully set forth herein.

BACKGROUND OF THE INVENTION

1. Field of the Invention

The present invention relates to an apparatus for implementing a 3-dimensional virtual sound and method thereof. Although the present invention is suitable for a wide scope of applications, it is particularly suitable for enabling implementation of 3-dimensional (3-D) virtual sound in such a mobile platform failing to be equipped with expensive instruments for the implementation of the 3-dimensional sound as a mobile communication terminal and the like.

2. Discussion of the Related Art

Recently, many efforts are made to the research and development of the 3-D virtual audio technology that can bring about a 3-dimensional sound effect using only a pair of speakers or a headset without employing high-grade equipments in a multimedia device that requires 3-dimensional virtual reality for multimedia contents, CD-ROM title, game player, virtual reality and the like. In the 3-D virtual audio technology, sensibilities of direction, distance, space and the like are formed as if a sound comes from the position where the virtual sound source is located in a manner of establishing a sound source at a specific position via headset or speaker to enable a user to listen to the sound.

In most of the 3-D virtual audio technologies, a head related transfer function (hereinafter abbreviated HRTF) is used to give a virtual sound effect to a speaker or headset.

The virtual sound effect is to bring about an effect such that a sound source is located at a specific position in a 3-dimensional virtual space. And, the virtual sound effect is achieved by filtering the sound stream from a mono sound source with head related transfer function (HRTF).

The head related transfer function (HRTF) is measured in an anechoic chamber by targeting on a dummy head. In particular, Pseudo-random binary sequences are output from a plurality of speakers that are spherically deployed at various angles centering on the dummy head within the anechoic chamber, respectively and the received signals are then measured by microphones provided to both ears of the dummy head to compute the transfer functions of the acoustic paths. And, this transfer function is called a head related transfer function (HRTF).

A method of seeking a head related transfer function (HRTF) is explained in detail as follows.

First of all, elevations and azimuths are subdivided into predetermined intervals centering on a dummy head, respectively. Speakers are placed at the subdivided angles, e.g., 10° each, respectively. Pseudo-random binary sequences are output from a speaker placed at each position on this grid of subdivided angles. Signals arriving at right and left microphones, placed in the ears of the dummy head, are then measured. The impulse responses and hence the transfer functions of the acoustic paths from the speaker to the left and right ear are then computed. An unmeasured head related transfer function in a discontinuous space can be found by interpolation between neighbor head related transfer functions. Hence, a head related transfer function database can be established in the above manner.

As mentioned in the foregoing description, the virtual sound effect is to bring about an effect that a sound source seems to be located at a specific position in a 3-D virtual space.

The 3-D virtual audio technology can generate an effect that a sound can be sensed at a fixed specific position and another effect that a sound moves away from one position into another position. In particular, the static or positioned sound generation can be achieved by performing a filtering operation using a head related transfer function at a corresponding position of the audio stream from a mono sound source. And, a dynamic or moving sound generation can be achieved by performing filtering operations, in a continuous manner, using a set of Head-related functions (corresponding to the different points on the trajectory of the moving sound source) with the audio stream from a mono sound source.

Since the above-explained 3-D virtual audio technology needs storage space for storing a large database of head related transfer functions to generate the static (positioned) and dynamic (moving) sounds and also requires a lot of computations for the execution of the filtering operation on the signal from the mono sound source with the head related transfer function, high-performance hardware (HW) and software (SW) equipments are necessary for real-time implementation.

Besides, in applying the 3-D virtual audio technology to movies, virtual realities, games and the like, which need the implementation of the virtual 3-D sound for multiple moving sounds, the following problems are brought about.

First of all, if the HRTFs are directly approximated using low-order IIR (infinite impulse response) filters, unique for each position in 3-dimensional space (as done in existing proposals due to the ability of IIR filters to model HRTFs with lower computational complexity compared to the FIR (finite impulse response) filters), in order to simulate a mono-sound source moving from one position to another using the 3-D virtual audio technology, a switching from one IIR (infinite impulse response) filter corresponding to the initial position of the sound source to another IIR filter corresponding to a next position in the sound source trajectory is needed.

Yet, while the sound source makes a transition from one position in space to another, switching between two IIR filters modeling HRTFs can make the system unstable and may give rise to audible "clicking" noise while making a transition from one filter to the other.

Secondly, if the HRTF model is unique to a location in space, as exist in many state-of-art systems, simulation of a set of sound sources occupying different positions in space requires a set of filters modeling the HRTFs corresponding to the positions of the sound sources in the auditory space. To simulate N sound sources, N filters need to be operational in real-time. Hence, complexity scales up linearly as the number of sound sources in the set increases. In particular, to give the 3-D sound effect according to the multiple moving sounds to multimedia contents such as movies, virtual realities, games and the like, high-performance hardware and software equipments capable of providing a large-scale storage space and real-time operation capability are needed.

SUMMARY OF THE INVENTION

Accordingly, the present invention is directed to an apparatus for implementing a 3-dimensional virtual sound and method thereof that substantially obviate one or more problems due to limitations and disadvantages of the related art.

An objective of the present invention is to provide an apparatus for implementing a 3-dimensional virtual sound and method thereof, in which system stability is secured, in which computational complexity and storage complexity are reduced for simulating multiple sound sources compared to the state-of-art, and by which the 3-dimensional virtual sound can be implemented in such a mobile platform failing to be equipped with expensive instruments for the implementation of the 3-dimensional sound as a mobile communication terminal and the like.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objectives and other advantages and in accordance with the purpose of the invention, as embodied and broadly described herein, a method of synthesizing a 3-dimensional sound according to the present invention includes a first step of giving an inter-aural time delay (ITD) to at least one input sound signal, a second step of multiplying output signals of the first step by principal component weight, and a third step of filtering result values of the second step by a plurality of low-order models of basis vectors extracted from a head related transfer function (HRTF).

Preferably, in the first step, a left signal and a right signal are generated by giving the inter-aural time delay according to a position of the at least one input sound signal.

More preferably, in the second step, the left and right signals are multiplied by a left principal component weight and a right principal component weight corresponding to an elevation $\phi$ and azimuth $\theta$ according to the position of the at least one input sound signal, respectively.

More preferably, the method further includes a step of filtering the sound signals, multiplied by principal component weight, by the plurality of low-order models of the basis vectors.

More preferably, the method further includes a step of adding up signals filtered by the plurality of low-order models of the basis vectors to be sorted per left signals and per right signals, respectively.

Preferably, the plurality of basis vectors include direction-independent mean vector and a plurality of directional basis vectors.

More preferably, the plurality of basis vectors are extracted from the head related transfer function by Principal Component Analysis (PCA).

More preferably, the plurality of basis vectors are modeled by an IIR (infinite impulse response) filters.

More preferably, the plurality of basis vectors are modeled with balance model approximation technique.

In a second aspect of the present invention, an apparatus for synthesizing a 3-dimensional stereo sound includes an ITD (inter-aural time delay) module for giving an inter-aural time delay (ITD) to at least one input sound signal, a weight applying module for multiplying output signals output from the ITD module by principal component weight, and a filtering module for filtering result values output from the weight applying module by a plurality of low-order models of the basis vectors extracted from a head related transfer function (HRTF).

Preferably, the apparatus further includes an adding module adding up signals filtered by a plurality of the low-order basis vector models to be sorted per left signals and per right signals, respectively.

In a third aspect of the present invention, a mobile terminal comprises the above-mentioned apparatus for implementing a 3-directional sound.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
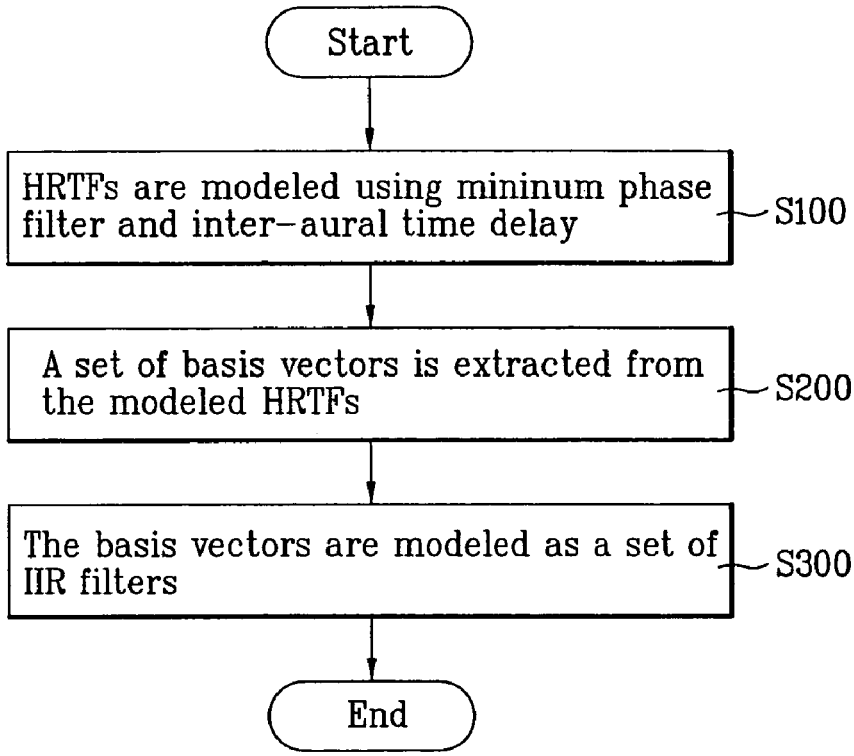
FIG. 1 is a flow chart of an HRTF modeling method for sound synthesis according to one preferred embodiment of the present invention.

Referring to FIG. 1, an HRTF modeling method for a multiple moving sound synthesis proposed by the present invention is explained as follows.

First of all, HRTFs in each and every direction are modeled using minimum phase filter and inter-aural time delay. [S100].

A set of basis vectors is then extracted from the modeled HRTFs using the statistical feature extraction technique [S200]. In this case, the extraction is to be done in the time-domain. The most representative statistical feature extracting method in capturing variance of the data set is Principal Component Analysis (PCA), which is disclosed in detail in J. Acoust. Soc. Am. 120(4) 2211-2218 pp. (October, 1997, Zhenyang Wu, Francis H. Y. Chan, and F. K. Lam, "A time domain binaural model based on spatial feature extraction for the head related transfer functions"), which is entirely incorporated herein by reference.

The basis vectors are explained in brief as follows. First of all, the basis vectors include one direction-independent mean vector and a plurality of directional basis vectors. The directional-independent mean vector means a vector representing a feature that is decided regardless of a position (direction) of a sound source among various features of the modeled HRTFs (head related transfer functions) in each and every direction.

On the other hand, the directional basis vector that represents a feature that is decided by a position (direction) of a sound source.

Finally, the basis vectors are modeled as a set of IIR filters based on the balance model approximation technique [S300]. The balanced model approximation technique is disclosed in detail in "IEEE Transaction on Signal Processing, vol. 40, No. 3, March, 1992" (B. Beliczynski, I. Kale, and G. D. Cain, "Approximation of FIR by IIR digital filters: an algorithm based on balanced model reduction"), which is entirely incorporated herein by reference. From simulation it is observed that the balanced model approximation technique models the basis vectors precisely with low computational complexity.

Figure 2:
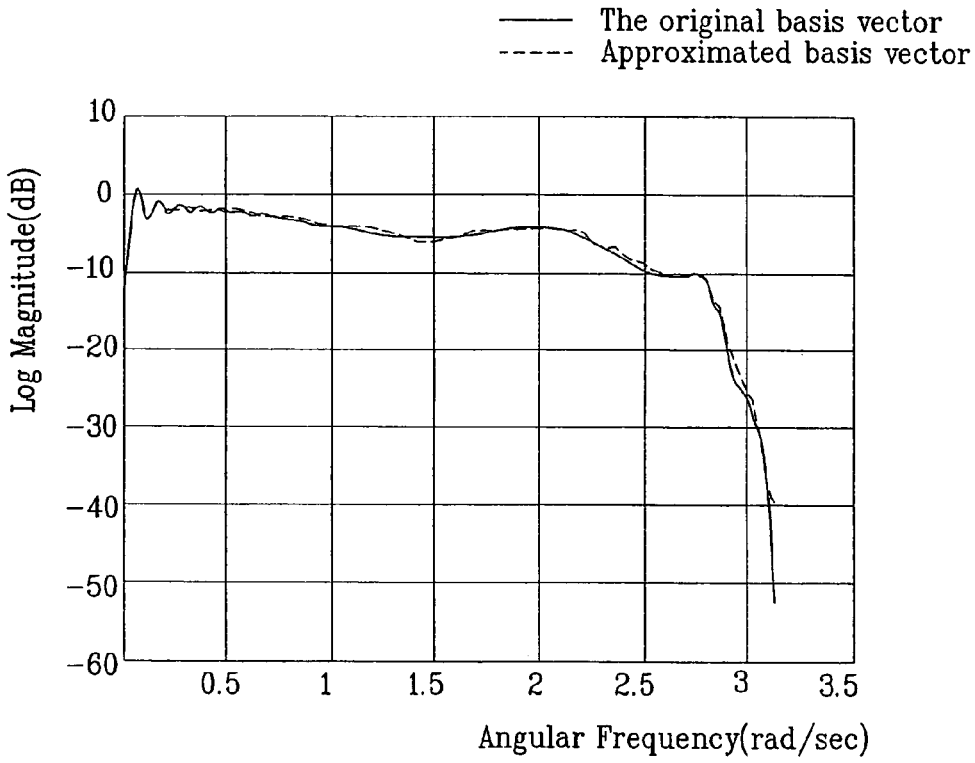
FIG. 2 is a graph of 128-tap FIR model of the direction-independent mean vector extracted from the KEMAR database and the low-order model of the direction-independent mean vector approximated according to one preferred embodiment of the present invention.
Figure 3:
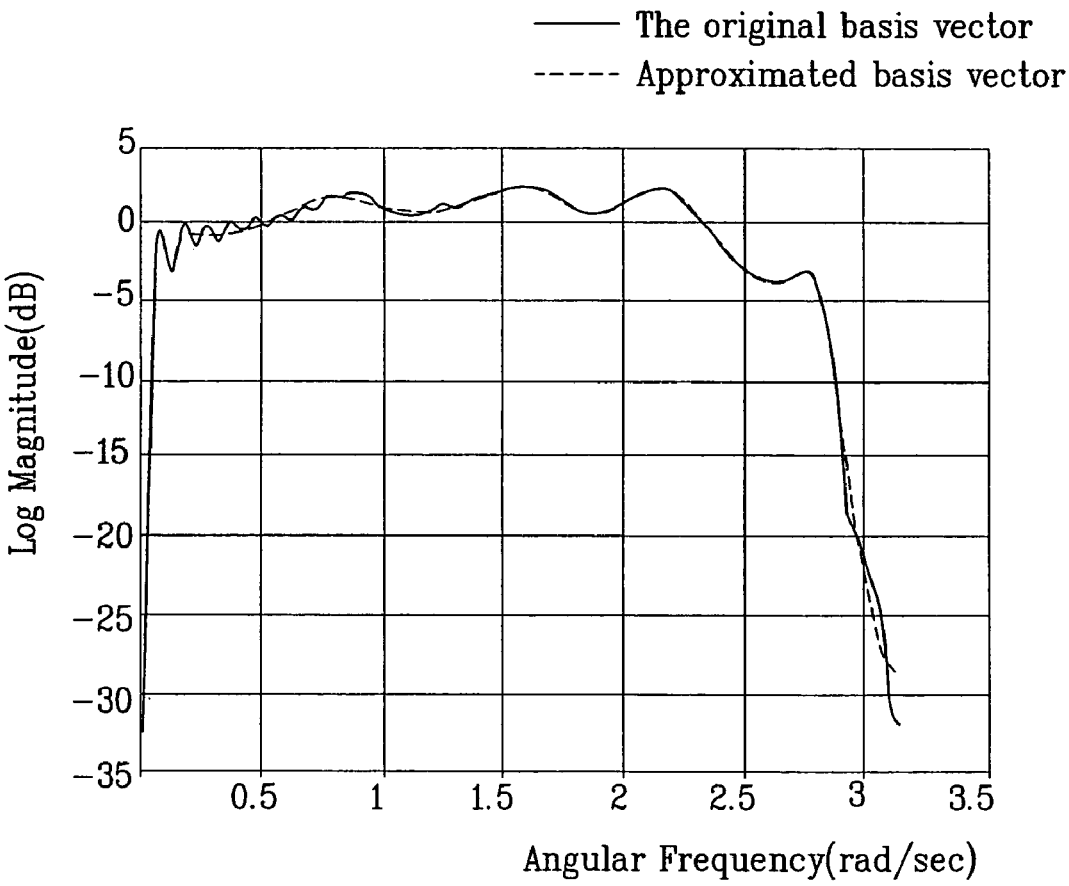
FIG. 3 is a graph of 128-tap FIR model of the most significant basis vector extracted from the KEMAR database and the low-order model of the same approximated according to one preferred embodiment of the present invention.

FIG. 2 shows the 128-tap FIR model of the direction-independent mean vector extracted from the KEMAR database and the low-order model of the direction-independent mean vector approximated using the previously mentioned steps. The order of the IIR filter approximating the direction-independent mean vector is 12. FIG. 3 shows the 128-tap FIR model of the first significant directional basis vector extracted from the KEMAR database and the low-order model of the first significant directional basis vector approximated using the previously mentioned steps. The order of the IIR filter approximating the directional basis vector is 12. It is apparent from FIG. 2 and FIG. 3 that the approximation is quite precise. A description of KEMAR database, publicly available at http://sound.media.mit.edu/KEMAR.html is disclosed in details in J. Acoust. Soc. Am. 97 (6), pp. 3907-3908 (Gardner, W. G., and Martin, K. D. HRTF measurements of a KEMAR), which is entirely incorporated herein by reference.

An overall system structure of an apparatus for implementing a 3-dimensional virtual sound according to one preferred embodiment of the present invention is explained with reference to FIG. 4 as follows. The embodiment explained in the following description is to explain details of the present invention and should not be construed as restricting a technical scope of the present invention.

Figure 4:
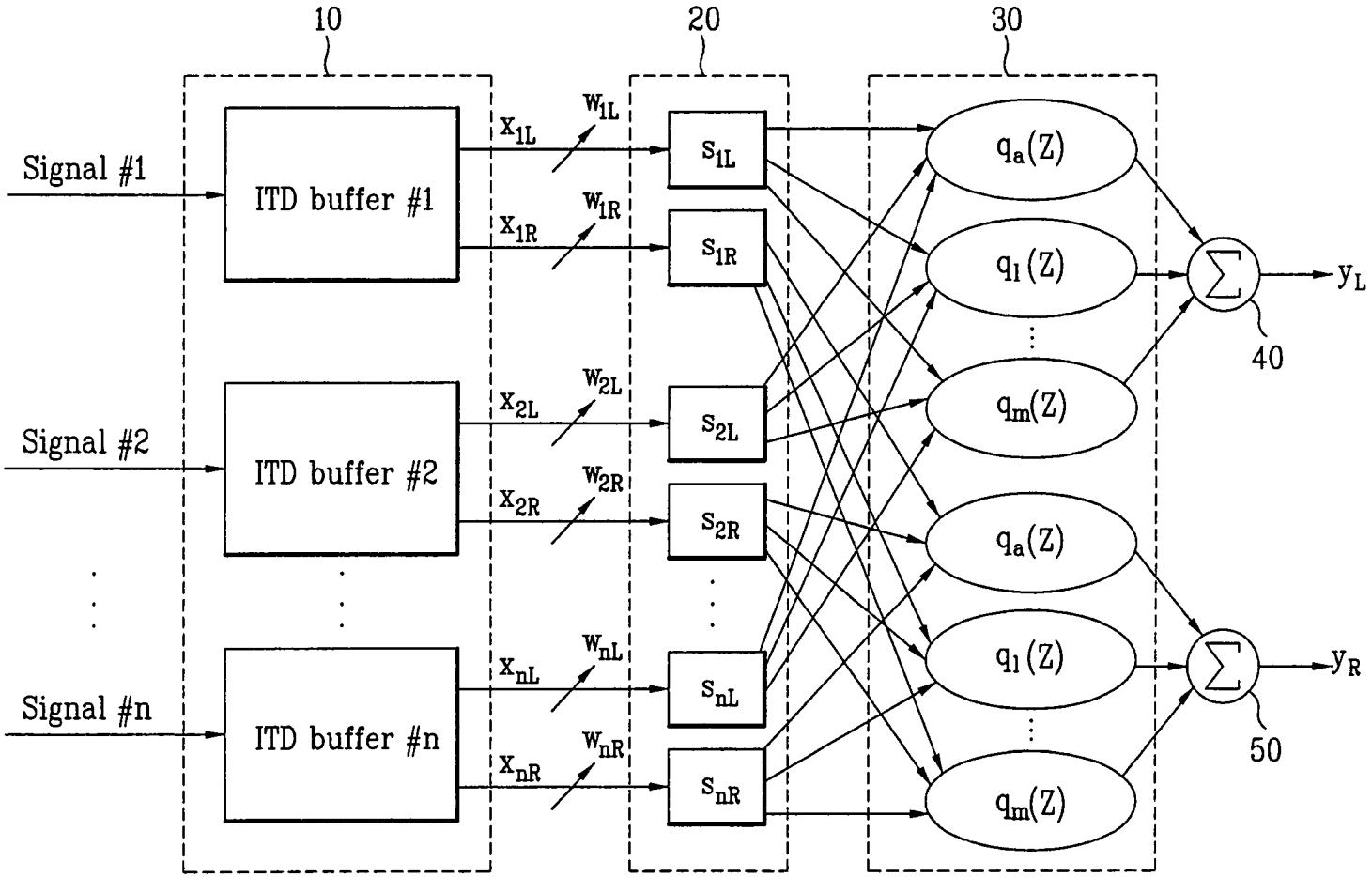
FIG. 4 is a block diagram of an apparatus for implementing a 3-dimensional virtual sound according to one preferred embodiment of the present invention.

Referring to FIG. 4, an apparatus for implementing a 3-dimensional virtual sound according to one preferred embodiment of the present invention includes an ITD module 10 for generating left and right ear sound signals by applying an ITD (inter-aural time delay) according to a position of at least one input sound signal, a weight applying module 20 for multiplying the left and right signals by left and right principal component weights corresponding to an elevation $\phi$ and an azimuth $\theta$ of the position of the at least one input sound signal, respectively, a filtering module 30 for filtering each result value of the weight applying module 20 by a plurality of IIR filter models of the basis vectors extracted from a head related transfer function (HRTF), and first and second adding modules 40, 50 for adding to output the signals filtered by a plurality of the basis vectors.

The ITD module 10 includes at least one or more ITD buffers ($1^{st}$ to $n^{th}$ ITD buffers) corresponding to at least one or more mono sound signals ($1^{st}$ to $n^{th}$ signals), respectively. Each of the ITD buffers gives an inter-aural time delay (ITD) according to the position of each of the sound signals to generate left and right signal streams $x_{iL}$ and $x_{iR}$ for left and right ears, respectively (where, i==1, 2, . . . , n). In other words, one of the left and right signal streams will be the delayed version of the other. The delay may be zero if the corresponding source position is on the median plane.

The weight applying module 20 outputs [$\hat{s}_{aL}$;$\hat{s}_{jL}$, j=1, 2, . . . , m] and [$\hat{s}_{aR}$;$\hat{s}_{jR}$, j=1, 2, . . . , m] by multiplying a plurality of the left and right signal streams from the ITD module 10 by left and right principal component weights $w_{jL}(\theta_i,\phi_i)$, j==1, 2, . . . , m and $w_{jR}(\theta_i,\phi_i)$, j=1, 2, . . . , m corresponding to the elevation $\phi_i$ and the azimuth $\theta_i$ of the position of the input sound signal i, i=1, 2, . . . , n respectively. In this case, $\hat{s}_{aL}$, $\hat{s}_{jL}$, j=1, 2, . . . , m $\hat{s}_{aR}$, and $\hat{s}_{jR}$, j=1, 2, . . . , m are calculated by Formulas 1 to 4, respectively.

$$\hat{s}_{jL} = \sum_{i=1}^{n} x_{iL} w_{jL}(\theta_i, \phi_i),\ j = 1, 2, \ldots, m \quad \text{[Formula 1]}$$

$$\hat{s}_{jR} = \sum_{i=1}^{n} x_{iR} w_{jR}(\theta_i, \phi_i),\ j = 1, 2, \ldots, m \quad \text{[Formula 2]}$$

$$\hat{s}_{aL} = \sum_{i=1}^{n} x_{iL} \quad \text{[Formula 3]}$$

$$\hat{s}_{aR} = \sum_{i=1}^{n} x_{iR} \quad \text{[Formula 4]}$$

The filtering module 30 carries out filtering on the $\hat{s}_{aL}$ and $\hat{s}_{aR}$ using directional-independent mean vector model $q_a(z)$. $q_a(z)$ is the transfer function of the directional-independent mean vector model in z-domain. $\hat{s}_{jL}$, j=1, 2, . . . , m and $\hat{s}_{jR}$, j=1, 2, . . . , m are filtered by the m most significant directional basis vector models $q_j(z)$, j=1, 2, . . . , m respectively. $q_j(z)$, j=1, 2, . . . , m denote the transfer functions of the m most significant directional basis vector models in z-domain. If the number of the directional basis vectors is raised higher, it gets more preferable in aspect of accuracy. If the number of the directional basis vectors is lowered, it gets more preferable in aspect of storage complexity and computational complexity. Yet, as a result of simulation, even if the number m of the directional basis vectors is raised, it is found out that there exists a critical point that the accuracy is not considerably raised despite the increment of the number m of the directional basis vectors. In this case, the critical point has the number m=7.

Let $\hat{s}_{aL}(z)$ and $\hat{s}_{jL}(z)$, j=1, 2, . . . , m are the z-domain equivalents of the time-domain sound streams $\hat{s}_{aL}$ and $\hat{s}_{jL}$, j=1, 2, . . . , m. The first adding module 40 adds up result values of the $\hat{s}_{aL}(z)$ and $\hat{s}_{jL}(z)$, j=1, 2, . . . , m filtered by the filtering module 30 and then outputs the corresponding result. The output value of the first adding module 40 can be represented as Formula 5.

$$y_L(z) = \sum_{j=1}^{m} \hat{s}_{jL}(z) q_j(z) + \hat{s}_{aL}(z) q_a(z) \quad \text{[Formual 5]}$$

Let $\hat{s}_{aR}(z)$ and $\hat{s}_{jR}(z)$, j=1, 2, . . . , m are the z-domain equivalents of the time-domain sound streams $\hat{s}_{aR}$ and $\hat{s}_{jR}$, j=1, 2, . . . , m. The second adding module 50 adds up result values of the $\hat{s}_{aR}(z)$ and $\hat{s}_{jR}(z)$, j=1, 2, . . . , m filtered by the filtering module 30 and then outputs the corresponding result. The output value of the second adding module 50 can be represented as Formula 6.

$$y_R(z) = \sum_{j=1}^{m} \hat{s}_{jR}(z) q_j(z) + \hat{s}_{aR}(z) q_a(z) \quad \text{[Formual 6]}$$

For notational simplicity Formula 5 and Formula 6 are expressed in z-domain. The filtering operations are performed in time-domain in the implementation. By converting the output values $y_L(z)$ (or time-domain equivalent $y_L$) and $y_R(z)$ (or time-domain equivalent $Y_R$) to analog signals to output via speakers or headsets, the 3-dimensional virtual sound can be produced.

In the present invention, the number of the basis vectors are fixed to a specific number regardless of the number of input sound signals. Compared to the related art that the operation amount linearly increases according to the increment of the number of the sound sources, the present invention does not considerably increase the operation amount despite the incremented number of the sound sources. Using low-order IIR filter models of the basis vectors in the present innovation reduces the computational complexity significantly, particularly at high sampling frequency e.g. 44.1 KHz of CD-quality audio. Since the basis vectors, obtained from HRTF dataset, are significantly higher order filters, this approximation using low-order IIR filter models reduces computational complexity. Modeling the basis vectors using balanced model approximation technique enables precise approximation of the basis vectors using lower order IIR filters.

In the following description of the present invention, an implementation of a 3-dimensional sound in a game software drivable in such a device as a PC, a PDA, a mobile communication terminal and the like is exemplarily explained as the preferred embodiment of the present invention shown in FIG. 4. This is only to facilitate an understanding of the technical features of the present invention. Namely, the respective modules shown in FIG. 4 are implemented in the PC, PDA or mobile communication terminal, by which an example of implementing a 3-dimensional sound is explained for example.

A memory of a PC, PDA or mobile communication terminal stores all sound data used in a game software, left and right principal component weights corresponding to an elevation $\phi$ and an azimuth $\theta$ according to a position of a sound signal each, and a plurality of low-order modeled basis vectors extracted from a head related transfer function (HRTF). In case of the left and right principal component weights, it is preferable that the elevation $\phi$ and azimuth according to a position of a sound signal each and values of the left and right principal component weights corresponding to the elevation $\phi$ and azimuth $\theta$ are stored in a format of a lookup table (LUT).

At least one or more necessary sound signals are input to the ITD module 10 according to algorithm of the game software. Positions of the sound signals input to the ITD module 10 and elevations $\phi$ and azimuths $\theta$ according to the positions shall be decided by the algorithm of the game software. The ITD module 10 generates left and right signals by giving an inter-aural time delay (ITD) according to each of the positions of the input sound signals. In case of a moving sound, a position and an elevation $\phi$ and azimuth $\theta$ according to the position are determined according to a sound signal of each frame matching synchronization with a screen video data.

The weight applying module 20 outputs $\hat{s}_{aL(z);\hat{s}jL}(z)$, j=1, 2, . . . , m and $\hat{s}_{aR}(z);\hat{s}_{jR}(z)$, j=1, 2, . . . , m by multiplying a plurality of the left and right signals output from the ITD module 10 by left and right principal component weights $w_{jL}(\theta_i,\phi_i)$ and $w_{jR}(\theta_i,\phi_i)$ corresponding to the elevation $\phi_i$ and the azimuth $\theta_i$ of the position of the input sound signal stored in the memory, respectively.

The $[\hat{s}_{aL};\hat{s}_{jL}$, j=1, 2, . . . , m] and $[\hat{s}_{aR};\hat{s}_{jR}$, j=1, 2, . . . , m] are output from the weight applying module 20 are input to the filtering module 30 modeled by IIR filters and are then filtered by a directional-independent vector $q_a(z)$ and m directional basis vectors $q_j(z)$, j=1, 2, . . . , m.

Result values of the $[\hat{s}_{aL};\hat{s}_{jL}$, j=1, 2, . . . , m] filtered by the filtering module 30 are added up together by the first adding module 40 and are then outputted as a left audio signal $y_L$. And, Result values of the $[\hat{s}_{aR};\hat{s}_{jR}$, j=1, 2, . . . , m] filtered by the filtering module 30 are added up together by the second adding module 50 and are then outputted as a right audio signal. $y_R$ The left and right audio signals $y_L$ and $y_R$ are converted to analog signals from digital signals and are then output via speakers of the PC, PDA or mobile communication terminal, respectively. Thus, the three-dimensional sound signal is generated.

Accordingly the present invention provides the following effects or advantages.

First of all, computational complexity of the operation and memory requirement to implement 3-d sound for a plurality of moving sounds is not considerably increased. In case of using the 12-order IIR filter for each basis vector modeling, and one directional-independent basis vector and seven directional basis vectors, computational complexity can be estimated by the following formula.

$$\text{Computational Complexity}=2\times(\text{IIR filter order}+1)\times(\text{IIR filter number or basis vector number})=2\times(12+1)\times 8.$$

The complexity of adding a new sound source to this architecture involves addition of a separate ITD buffer and scalar multiplication of the sound stream using principal component weights. Filtering operation does not incur any extra cost. Secondly, instead of modeling the HRTFs using IIR filters the present invention uses IIR filter models of the basis vectors. As a result switching between the filters are not involved since the fixed set of basis vector filters are always operational irrespective of the position of the sound source. Hence synthesis of stable IIR filter models of the basis vectors is sufficient to guarantee system stability in run-time.

According to the above-explained effects, the present invention can implement the 3-dimensional virtual sound in such a device failing to be equipped with expensive instruments for the implementation of the 3-dimensional sound as a mobile communication terminal and the like. In particular, the present invention is more effective in movies, virtual realities, game and the like which need to implement virtual stereo sounds for multiple moving sound sources.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of implementing a 3-dimensional sound, the method comprising:

adding an inter-aural time delay (ITD) to at least one input sound signal;

multiplying the at least one input sound signal having the ITD added by a principal component weight to generate at least one weighted signal; and filtering the at least one weighted signal by a low-order model of each of a plurality of basis vectors extracted from a head related transfer function (HRTF), wherein the plurality of basis vectors comprise one direction-independent mean vector and a plurality of directional basis vectors, wherein the plurality of basis vectors are extracted from the HRTF by Principal Component Analysis (PCA) in time-domain, wherein the direction-independent mean vector is a vector that is not determined based on a position of a sound source and each of the plurality of directional basis vectors is a vector that is determined based on a position of a sound source, and wherein each of the plurality of basis vectors is modeled by an IIR (infinite impulse response) filter model to generate the low-order model of each of the plurality of basis vectors.

2. The method of claim 1, wherein the inter-aural time delay is generated according to a position of the at least one input sound signal to generate a left signal and a right signal.

3. The method of claim 2, wherein multiplying the at least one signal having the ITD added by the principal component weight to generate the at least one weighted signal comprises multiplying the left signal by a left principal component weight and multiplying the right signal by a right principal component weight, wherein each of the left principal component weight and right principal component weight corresponds to an elevation $\phi$ and azimuth $\theta$ according to the position of the at least one input sound signal.

4. The method of claim 3, further comprising adding the at least one weighted signal filtered by the low-order model of each of the plurality of basis vectors for sorting according to left signals and right signals.

5. The method of claim 1, wherein modeling by the IIR filter is performed by a balance model approximation technique.

6. An apparatus for implementing a 3-dimensional sound, the apparatus comprising:

an ITD (inter-aural time delay) module for adding an inter-aural time delay (ITD) to at least one input sound signal;

a weight applying module for multiplying signals output from the ITD module by principal component weight to generate weighted signals; and a filtering module for filtering the weighted signals from the weight applying module by a low-order model of each of a plurality of basis vectors extracted from a head related transfer function (HRTF), wherein the plurality of basis vectors comprise one direction-independent mean vector and a plurality of directional basis vectors, wherein the plurality of basis vectors are extracted from the HRTF by Principal Component Analysis (PCA) in time, wherein the direction-independent mean vector is a vector that is not determined based on a position of a sound source and each of the plurality of directional basis vectors is a vector that is determined based on a position of a sound source, and wherein each of the plurality of basis vectors is modeled by an IIR (infinite impulse response) filter model to generate the low-order model of each of the plurality of basis vectors.

7. The apparatus of claim 6, wherein the ITD module generates a left signal and a right signal by generating the inter-aural time delay according to a position of the at least one input sound signal.

8. The apparatus of claim 7, wherein the weight applying module multiplies the signals output from the ITD module by the principal component weight by multiplying the left signal by a left principal component weight and multiplying the right signal by a right principal component weight, wherein each of the left principal component weight and right principal component weight corresponds to an elevation $\phi$ and azimuth $\theta$ according to the position of the at least one input sound signal.

9. The apparatus of claim 8, further comprising an adding module for adding the weighted signals filtered by the low-order model of each of the plurality of basis vectors for sorting according to left signals and right signals.

10. The apparatus of claim 6, wherein the plurality of basis vectors are modeled by a balance model approximation technique.

11. The apparatus of claim 6, wherein the apparatus for implementing the 3-dimensional sound is a mobile terminal.

12. The method of claim 1, wherein the plurality of basis vectors are extracted from the HRTF in time-domain using a statistical feature extraction technique.

13. The method of claim 1, wherein a number of the plurality of directional basis vectors is fixed as a specific number regardless of a number of the at least one input sound signal.

14. The method of claim 13, wherein a maximum number of the plurality of directional basis vectors is seven.

15. The method of claim 3, further comprising storing the values of the left principal component weight and right principal component weight corresponding to the elevation $\phi$ and azimuth $\theta$ in a lookup table.

16. The apparatus of claim 6, wherein the plurality of basis vectors are extracted from the HRTF in time-domain using a statistical feature extraction technique.

17. The apparatus of claim 6, wherein a number of the plurality of directional basis vectors is fixed as a specific number regardless of a number of the at least one input sound signal.

18. The apparatus of claim 17, wherein a maximum number of the plurality of directional basis vectors is seven.

19. The apparatus of claim 8, further comprising a storage unit for storing the values of the left principal component weight and right principal component weight corresponding to the elevation $\phi$ and azimuth $\theta$ in a lookup table format.

20. The apparatus of claim 7, wherein the apparatus for implementing the 3-dimensional sound is a mobile terminal.

21. The apparatus of claim 8, wherein the apparatus for implementing the 3-dimensional sound is a mobile terminal.

22. The apparatus of claim 9, wherein the apparatus for implementing the 3-dimensional sound is a mobile terminal.

23. The apparatus of claim 6, wherein the apparatus for implementing the 3-dimensional sound is a mobile terminal.

24. The apparatus of claim 10, wherein the apparatus for implementing the 3-dimensional sound is a mobile terminal.

* * * * *